US005245308A

United States Patent [19]

Herbias

[11] Patent Number: 5,245,308

[45] Date of Patent: Sep. 14, 1993

[54] CLASS L FUSE

[75] Inventor: Cesar Herbias, Calumet City, Ill.

[73] Assignee: Littelfuse, Inc., Des Plaines, Ill.

[21] Appl. No.: 916,410

[22] Filed: Jul. 20, 1992

[51] Int. Cl.[5] ..... H01H 85/38; H01H 85/18

[52] U.S. Cl. ..... 337/273; 337/276; 29/623

[58] Field of Search ..... 337/273, 274, 275, 276, 337/277, 278, 279, 280, 281, 282, 283, 158, 159, 160, 161, 162, 163, 164, 165, 166; 29/623

[56] References Cited

U.S. PATENT DOCUMENTS 4,893,106 1/1990 Goldstein et al. ..... 337/159

*Primary Examiner*—Harold Broome

*Attorney, Agent, or Firm*—Wallenstein, Wagner & Hattis

[57] ABSTRACT

A Class L fuse comprises a pair of conductive elements at the opposite ends of the fuse. A fusible element is secured to and makes electrical contact with each of the conductive elements. A generally cylindrical housing encloses the fusible element. Finally, an insulating, free-flowing arc barrier-forming body or sealant is disposed within the housing. In particular, the arc barrier-forming body or sealant is disposed between a portion of the fusible element and each of the conductive elements.

13 Claims, 1 Drawing Sheet

CLASS L FUSE

DESCRIPTION

Technical Field

This invention relates generally to fuses for interrupting the flow of current through an electrical circuit upon predetermined overload conditions. More particularly, this invention has its most important application as an improvement in so-called Class L fuses for high-power applications.

BACKGROUND OF THE INVENTION

Class L fuses are used in high-power applications. As an example, Class L fuses are typically specified for service entrance equipment, switchboard mains and feeders, distribution equipment, and motor control centers. Class L fuses provide effective branch-circuit protection for large motors, and can be used for short-circuit isolation of fire pump circuits. Class L fuses are relatively large and heavy, and may have voltage ratings between 300 and 600 volts. Such fuses may have an interrupting rating of 200,000 amperes rms symmetrical, and an ampere rating of about 600 to 2000 amperes or more.

Current Class L fuses include a pair of conductive elements at the opposite ends of the fuse. Several fusible elements are secured to and make electrical contact with each of the opposed conductive elements. A generally cylindrical housing encloses the fusible elements. Sand is placed within the generally cylindrical housing, and this sand acts as an arc-quenching medium. Upon meeting certain minimum standards, Class L fuses are listed under UL Standard 198C promulgated by Underwriters' Laboratories, Inc. (hereinafter "UL").

Class L fuses prior to the present invention had several drawbacks. First, no Class L fuse existed which had an equally high UL rating for alternating current (AC) and direct current (DC). For example, a 600 volt, 1200 amp AC rated fuse typically had a DC rating of 300 volts. The reasons for this are not entirely known. It appeared, however, that sand placed within the interior of prior art Class L fuses was adequate only for quenching the arcs generated by high voltage AC currents, and not those created by high voltage DC currents.

A Class L fuse having both a 600 volt AC and a 600 volt DC rating would be desirable. Such a fuse could lower the number of fuse models made by fuse manufacturers and the inventory requirements of these relatively expensive fuses for both manufacturers and users.

A second drawback was that no known prior Class L DC fuse was UL rated at 600 volts. The highest rated Class L fuse previously known had a 500 volt rating.

A third drawback of prior Class L fuses concerned their performance under overload conditions. As stated above, current Class L fuses include sand surrounding the fusible elements and within the cylindrical fuse housing. This sand is intended as an arc-quenching medium. Nevertheless, arcs formed under certain severe conditions result in failure in some UL-listed Class L fuses. For example, arcs formed within such Class L fuses generally begin at or near the center of the fusible element, and then move quickly towards the opposing ends of the fuse. The sand would not fully quench such arcs, and the arcs would reach the inboard circular, disc-shaped end walls of the conductive elements. These arcs could literally eat away at the inner portion of these end walls and, under extreme conditions, create holes in the end walls. Obviously, this result is highly undesirable, as fuses are typically designed to safely contain any arcs, and prevent a rupture or breach through a fuse wall or through any other fuse structure. If a portion of a fuse wall or other structure is breached, parts of the contents of that fuse could be released into the surroundings. Such release carries the potential for harm to personnel and adjacent electrical devices.

Several possible solutions to these problems were contemplated, but abandoned. For example, Class L fuses include multiple, elongated, fusible elements spaced around the longitudinal axis of a fuse. A rubber disc acting as an arc barrier was proposed for placement at each inner end of the fuse, with slots for the passage of the fusible elements through that disc. After further consideration, problems were anticipated and this idea was rejected for several reasons.

First, these passage slots for the fusible elements could grow over time or be initially oversized. As a result, the integrity of the intended arc barrier-forming seal between the disc and fuse elements could not have been assured. Sand or other fine pulverulent material within the fuse interior could become wedged in these slots, compromising the arc barrier.

Second, a one-piece, slotted rubber disc would have to be placed over the fusible elements prior to soldering those elements onto the end walls. As a result, heat from the soldering process could have been transferred to and melted or distorted a portion of the rubber disc. The resulting seal between the interior of the fuse and the end walls of the fuse could have been compromised. Also, inserting the individual fusible elements into the disc slots would be a tedious and costly procedure.

Relevant prior art includes the above-described prior art Class L fuses, and also U.S. Pat. No. 4,636,765 (hereinafter "'765 patent"), issued to Littelfuse, Inc., the assignee of the present application, on Jan. 13, 1987. This patent is entitled "Fuse With Corrugated Element," and is directed to a fuse having a plug of initially solid, arc-quenching material 32. This arc-quenching material fills only one end of the fuse and is designed to evaporate under fuse blowing conditions. In addition, the arc-quenching material of the '765 patent surrounds only one fine, cylindrical fuse element 23. The arc-quenching material 32 disclosed may be selected from materials including thermoplastic polyamide polymers and polymerized fatty acids and silicates, such as those manufactured by the 3M Company, St. Paul, Minn., and sold as adhesives under Stock Nos. 3779 and XG-3793. The '765 patent does not suggest the use of silicone rubber-like materials for arc-quenching. These silicone rubber-like materials are the preferred arc-quenching materials in the present invention. The '765 patent also fails to suggest that the use of these materials may increase the DC voltage capacity of a Class L fuse. Further, the '765 patent does not teach the use of these materials in the manner of the present invention. Particularly, the '765 patent fails to teach the filling of gaps between the various fusible elements arranged around the longitudinal axis of the fuse.

SUMMARY OF THE INVENTION

The invention applies to a Class L fuse comprising a pair of conductive, terminal-forming elements at the opposite ends of the fuse. One or more, and preferably a plurality of, fusible elements are secured to and make electrical contact with each of the conductive, terminal-forming elements. A generally cylindrical housing encloses the fusible elements. An insulating arc barrier-forming body is disposed within the housing. In particular, the arc barrier-forming body is most advantageously disposed within the fuse at a point between an inboard portion of each fusible element and each of the terminal-forming conductive elements.

Each arc barrier-forming body is a sealant that is free-flowing and moves in a manner similar to a viscous liquid or slurry so that it can be applied in a quick and easy manner around and between the fusible elements. Also, the sealant fills in any cracks, gaps or crevices in the surrounding surfaces. Essentially, the sealant is form-fitted around its environment, and conforms to the shape of any container or structure within that container. The fusible elements are within this cylindrical housing, and the sealant is sprayed or otherwise applied to those elements to cover and completely surround a portion of the length of each fusible element. Preferably, the sealant is form-fitted around the fusible elements at an inboard point along a portion of the length of the fusible elements, adjacent the terminal-forming elements.

The Class L fuses in accordance with the invention include fusible elements secured around the axis defined by the opposing, conductive elements of the fuse, i.e., the axis of the housing. These fusible elements, however, may not be spaced uniformly about the axis. Rather, when viewed in cross section, the fusible elements are disposed radially along an asymmetrical, C-shaped segment of the end wall of the conductive elements. In other words, the fuse elements are spaced around only a portion of a 360 circular arc about the longitudinal axis. As a result, the sealant band is also C-shaped and forms an asymmetrical plug. In the preferred embodiment, this asymmetrical plug has a thickness of at least ¼ inch and as much as ¾ inch.

The objects of the invention include providing a Class L fuse having a DC rating as high as its AC rating. A further object of the invention is providing a UL-approved, Class L fuse having a DC voltage rating of at least 600 volts. A further object of the invention is providing a Class L fuse having improved safety characteristics which provides additional protection against arc-induced, destructive failure of Class L fuses. A further object of the invention is providing a method which (1) results in a Class L fuse avoiding the problems of the prior art; and (2) accomplishes the above-listed objects.

DETAILED DESCRIPTION OF THE PREFERRED EMBODIMENT

Figure 1:
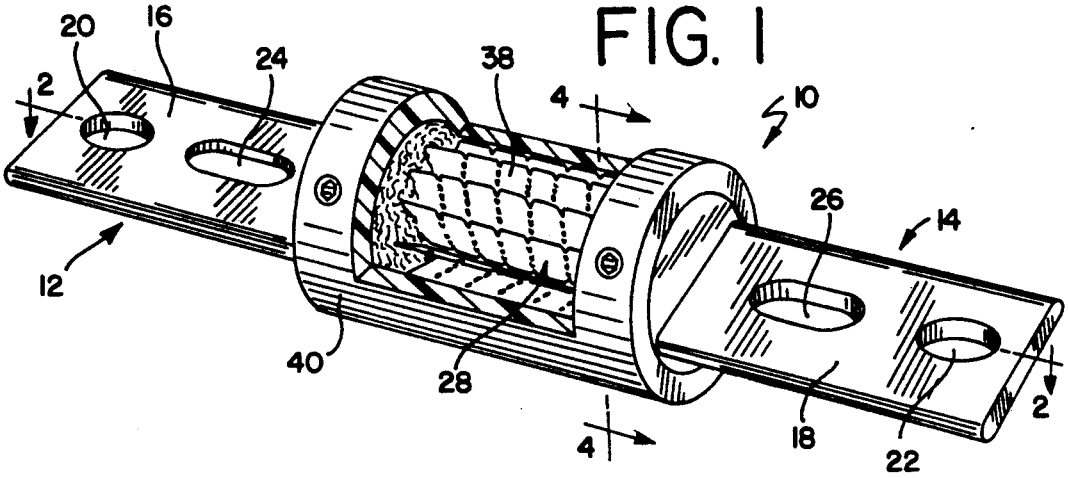
FIG. 1 is a perspective view of a Class L view, in accordance with the invention, with a portion of the melamine cylindrical housing cut away.
Figure 2:
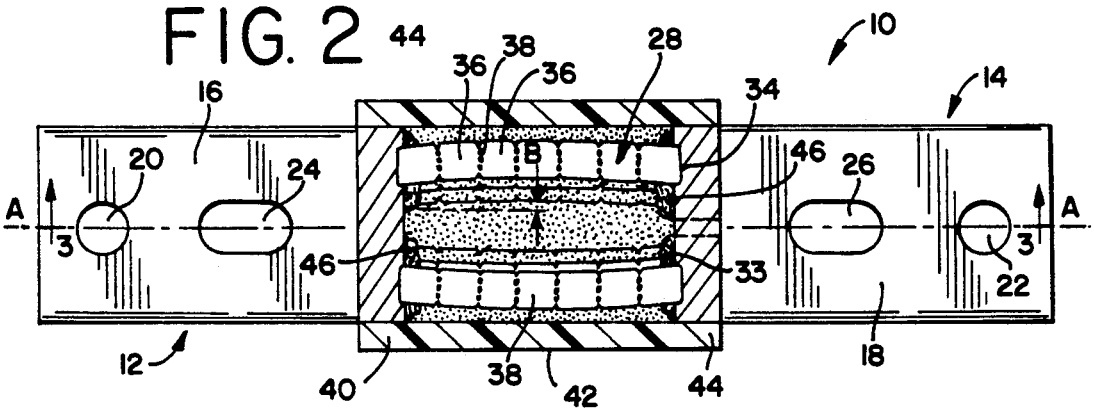
FIG. 2 is a top view of the fuse of FIG. 1, taken along lines 2—2 of FIG. 1.

The preferred embodiment of the invention may be best understood by reviewing this description in view of the drawings, FIGS. 1-4. FIG. 1 shows a perspective view of the fuse 10, with a portion of its housing cut away and removed to expose the interior elements of the fuse. It should be understood that these interior elements of the fuse are not normally visible, as the one-piece housing is opaque and typically intact.

Referring again to FIG. 1, the invention is a Class L fuse 10 comprising a pair of conductive, terminal-forming elements 12 and 14 at the opposite ends of the fuse 10. These conductive elements 12 and 14, which may also be referred to as end bells, are made of copper or any other suitable conductive metal. Each of these end bells 12 and 14 includes a terminal blade or arm 16 and 18, respectively. These terminal blades 16 and 18 extend longitudinally outward from their respective end walls. Molded or machined into each terminal blade 16 and 18 is a pair of mounting holes 20, 24 and 22, 26, respectively, for securing a 1200-amp fuse 10 in place during use. The endmost holes 20, 22 are nearly round, whereas the innermost holes 24, 26 have a more elongated, oblong shape. Standards call for these holes 20, 22 to have dimensions of ⅝ inch by ¾ inch. Standards for holes 24, 26 call for dimensions of ⅝ inch by 1⅛ inch. Various other mounting hole patterns are used for other Class L fuses.

At least one fusible element is secured to and makes electrical contact with each of the conductive, terminal-forming elements 12 and 14. In the present embodiment, a plurality of laterally-spaced fusible elements, typically eleven or twelve fusible elements 28, extend between and are electrically connected with each of the conductive elements 12 and 14. The fusible elements 28 are made of nearly pure silver metal. As few as seven and as many as twenty fusible elements may be used in a Class L fuse.

Figure 3:
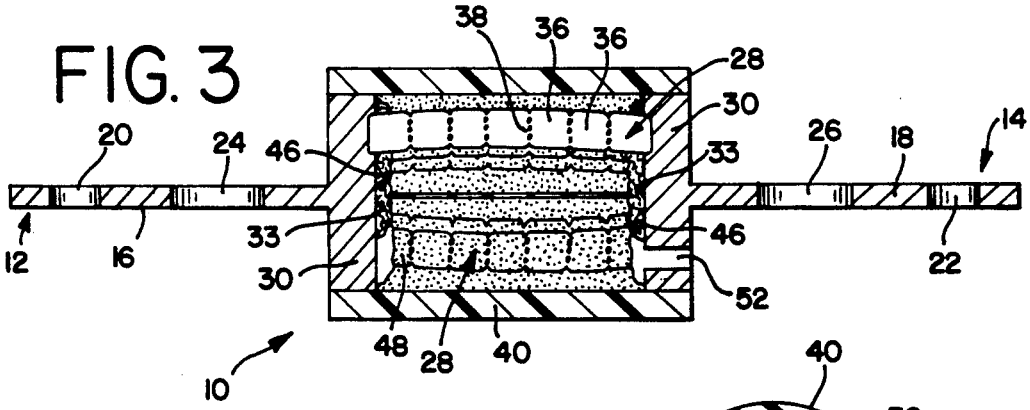
FIG. 3 is a longitudinal, sectional view of the fuse of FIG. 2, taken along lines 3—3 of FIG. 2.

As may be seen in FIG. 3, each of the conductive elements, including conductive element 14, includes an end wall 30. As may be seen in FIG. 4, slots 32 are spaced in a radial pattern around the end walls 30, and each distal end 34 of each fusible element 28 is inserted into a corresponding slot 32. After insertion, the ends 34 of each of the fusible elements 28 are secured, by soldering, within the slots 32 to an inner wall 33 of each of the conductive elements 12 and 14.

Slots 32 may be of varying depths. Accordingly, fusible elements 28 are constructed to have a length slightly longer than the minimum length that may be necessary. As a result, the fusible elements 28 are generally not tautly stretched across the length of the fuse 10. Rather, these fusible elements have a slight bow B, as may be seen by the arrows in FIG. 2. Typical bowing in the fuse can be as much as ¼ inch.

Each fusible element 28 is stamped from a single, thin sheet of silver. As a result of the stamping process, each of the fusible elements 28 takes on the appearance of an array of silver rectangles 36. In addition, each silver rectangle is attached to an adjacent silver rectangle along the fusible element 28 at 5 bridges or attachment points 38.

Figure 4:
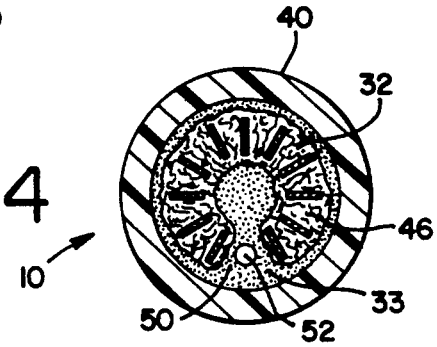
FIG. 4 is an end, sectional view of the fuse of FIG. 2, taken along lines 4—4 of FIG. 1.

Referring now to FIG. 3, fusible element 28 includes seven silver rectangles 36. The endmost two rectangles, as indicated above, are inserted into slots 32 of end walls 30. In the prior art Class L fuses, the length of these rectangles was approximately 0.275 inches. In the present invention, as shown in FIG. 4, the length of the two endmost rectangles is 0.565 inches. The length of the five innermost rectangles 28 is 0.310 inches. The reason that the first and seventh sections of the present fusible element 28 are longer is that it is believed that these longer sections decrease the chances that the arc may reach the end walls 30 of the fuse 10.

It will be understood by one skilled in the art that these changes in the lengths of the seven sections of fusible element 28 will increase the overall length of the fusible element 28, as compared to prior art Class L fuse fusible elements, by somewhat more than ½ inch. Thus, the thickness of each of the two end walls 30 should be reduced by somewhat over ¼ inch. As a result, the overall length of the novel Class L fuse will remain the same as the overall length of prior Class L fuses. In this way, the novel Class L fuse will fit into the same location as prior art Class L fuses.

A generally cylindrical modulating housing 40 forming member which, together with the conductive end walls 30—30, form an overall housing or enclosure which encloses the fusible elements 28. This housing is open-ended, and has a central portion 42 and end portions 44. In this embodiment, the generally cylindrical housing 40 is made of molded melamine. The housing 40 of the 1200-amp fuse has a length of 3¾ inches to 4 inches, an outside diameter of 2½ inches, a wall thickness of ¼ inch, and an inside diameter of 2 inches.

An insulating, free-flowing sealant 46 which acts as an arc barrier-forming body is disposed on the inner wall 33 near each end portion 44 of the assembled housing 40. This arc barrier-forming body 46 is disposed between an inboard portion 48 of the fusible element 28 and each of the conductive elements 12 and 14. The arc barrier-forming body 46 at each end 44 of the assembled housing 40 forms a plug which fills most, but not all, of the adjacent end portion 44 of the housing 40. In addition, as may be seen in FIG. 4, this arc barrier-forming body 46 extends over and intimately contacts the inwardly-facing inner wall 33 of each end wall 30.

The preferred arc barrier-forming material is sold under the trade name RTV Silicone Rubber, Catalog No. RTV 162, White, EC 779. This product is manufactured by General Electric Company, Silicone Products Division, Waterford, N.Y. 12188. This RTV sealant is free-flowing at room temperature and moves in a manner similar to that of a viscous liquid or slurry. After exposure to air, the RTV sealant cures and hardens, increasing in viscosity until it essentially becomes a solid.

In its uncured, slurry-like state, however, this arc barrier-forming material 46 fills in any cracks, gaps or crevices in the surrounding surfaces and the spaces between the fusible elements 28. Thus, in the present eleven element embodiment, the RTV sealant 46 completely and intimately surrounds each of the fusible elements 28 at inboard portions 48 of those elements 28. Essentially, the sealant is form-fitted around its environment and conforms to the shape of the adjacent structures.

The sealant 46 is sprayed onto the portion of inner wall 33 adjacent the fusible element 28, covering and completely surrounding a portion of the length of that fusible element. Although the sealant 46 isolates an inboard portion 48 of the element 28 from the inner wall 33 of the conductive element 12, the entire fusible element 28 remains in electrical contact with both conductive elements 12 and 14.

In the preferred embodiment, the sealant 46 does not form a conventional cylindrical plug. Rather, because of the asymmetrical spacing of the fusible elements 28 along the inner wall 33 of the conductive elements, only enough sealant 46 to form a C-shaped plug, when viewed in the cross section of FIG. 4, is required. A gap 50 appears between the ends of the C-shaped sealant band, and its location coincides with that of a filling aperture 52 in conductive element 14. Each body of the arc barrier-forming material 46 at each end wall 30 of the housing has a generally C-shaped cross section in a plane transverse to the longitudinal axis of the housing 40, as may be seen in FIG. 4. Thus, the filling aperture 52 is located at a point in the end wall 30 where there are also no fuse elements 28. The asymmetrical C-shaped mass of sealant 46 in the preferred embodiment has a thickness of between ¼ inch and ¾ inch.

Sand or another pulverulent material is inserted through this filling aperture 52 into the fuse body to act as an arc-quenching material for the fuse 10. After the fuse 10 has been filled with the pulverulent material, this filling aperture 52 is stopped with a plug made of metal or another suitable material.

The Class L fuse of the invention may be made by the following novel method. This method results in a fuse constructed from an initially open-ended housing 40 which is to be filled with a pulverulent insulating material. Conductive end walls 30 close the open ends of the housing 40, and terminal blades 12 and 14 extend longitudinally outward from the end walls 30. A plurality of fusible elements 28 extend between and are electrically connected to the end walls 30, and the fusible elements 28 are arranged in spaced relation around the longitudinal axis of the housing. The housing is filled with a pulverulent insulating material after the housing 40 has been positioned along and secured to the conductive elements 12 and 14.

The method comprises the steps of positioning the conductive end walls 30 so that the terminal blades 16 and 18 extend outwardly from the inner wall 33 side of those conductive end walls 30. In other words, the terminal blades 16 and 18 point in opposite directions. One of the end walls 30 has a filling aperture 52 spaced from the longitudinal or central axis formed between the centers of the conductive end walls.

The fuse elements 28 are connected between the end walls 30 so that they are arranged in spaced relation around the longitudinal axis "A" extending between the centers of the end walls 30. A body of arc barrier-forming material 46 is then applied in a plastic or slurry-like state around and between the inboard portions 48 of all of the fuse elements 28 and near each conductive end wall 30.

As indicated above, Class L fuses in accordance with the invention can have as few as seven and as many as twenty fusible elements 28 positioned around the axis of the fuse. The body of arc barrier-forming material 46 is applied in its plastic or slurry-like state around the fusible elements 28 adjacent each conductive end wall 30. When the fuse 10 includes a low number of elements, such as seven fuse elements, the arc barrier-forming material 46 applied around one fusible element 28 does not contact the arc barrier-forming material 46 applied around the adjacent fuse element 28. As a result, the body of arc barrier-forming material 46 in a fuse having as few as seven elements does not have the continuous appearance shown in FIG. 4. Rather, there are spaces, gaps or crevices between the adjacent masses of arc barrier-forming material 46. When viewed in cross section, these bases would expose a portion of the end wall 30 between adjacent fuse elements 28.

The housing 40 with open ends is then placed over the end walls 30. When that housing 40 is fully applied over the fusible elements 28 and end walls, the end walls 30 are positioned to close the formerly open ends of the housing 40.

The housing 40 is then anchored to the end walls in a conventional manner, i.e., in a drilling and pinning operation. The remaining spaces in the interior of the housing 40 are then filled with sand or another pulverulent material through the filling aperture 52. Finally, the filling aperture 52 is sealed by a plug or the like.

The objects of the invention include a Class L fuse having a DC rating as high as its AC rating. These objects are accomplished by the present invention, which has an AC and DC rating of 600 volts. A further object accomplished by the present invention is a UL-approved, Class L fuse having a DC voltage rating of at least 600 volts. A further object satisfied by the invention is a Class L fuse having improved safety characteristics which provides additional protection against arc-induced, destructive failure of Class L fuses.

The present invention also provides a method which permits manufacture of a fuse without the risks that would have been inherent in soldering after the placing of a rubberized material between the fuse elements and the end wall of a fuse. The method of the present invention provides a secure seal between the interior of the fuse and the end walls of the fuse. Sand or other pulverulent material within the fuse is inhibited from passing from the interior of the fuse, i.e., the portion of the fuse between the two sealant plugs 46, to the end wall.

In the present method, the fusible elements 28 are soldered to the end walls 30, and the end walls 30 are permitted to cool. Only then is the sealant 46 sprayed or otherwise applied around the fusible elements 28. As a result, there is no heat transfer from a soldering process, and no possibility that heat generated by that process could melt the sealant. The resulting seal between the interior of the fuse and the end walls of the fuse will, as a result, not be compromised by heat.

While the specific embodiments have been illustrated and described, numerous modifications come to mind without markedly departing from the spirit of the invention. The scope of protection is, thus, only intended to be limited by the scope of the accompanying Claims.

What I claim is:

1. A fuse comprising:

a. a pair of conductive, terminal-forming elements at the opposite ends of said fuse;

b. a plurality of laterally-spaced fusible elements secured between and making electrical contact with each of said terminal-forming conductive elements;

c. a housing enclosing said fusible elements, said housing having a central portion and end portions; and d. a first, self-supporting insulating, arc barrier-forming body at each of said end portions of said housing and terminating short of the central portion of said housing, each such body intimately surrounding said plurality of fusible elements along a portion of their lengths and filling the spaced between said fusible elements.

2. The fuse of claim 1, wherein said first arc barrier-forming body at each end portion of said housing forms a plug having an extent which substantially fills each end portion of the housing.

3. The fuse of claim 1, wherein each of said first bodies of arc barrier-forming material extends over and intimately contacts the inner surface of each end wall.

4. The fuse of claim 1 wherein said first arc barrier-forming body at each end of said housing comprises an initially free flowing body of material when applied to said fuse elements which then hardens to become an essentially solid body.

5. The fuse of claim 1 wherein said arc barrier-forming body of each end of said housing is a silicon rubber material.

6. The fuse of claim 1 wherein there is a second body of an arc quenching material between the self-supporting arc barrier-forming body at each end of the housing, said arc quenching material substantially filling the space between said self-supporting arc barrier-forming bodies.

7. In a fuse having an open-ended insulating housing member, said housing member having a central portion and end portions, conductive end walls closing the open ends of the housing member, terminals extending longitudinally outward from said end walls, a plurality of fuse elements extending between and electrically connected to said end walls and arranged in laterally spaced relation around the longitudinal axis of said housing member, and said housing member containing a pulverulent insulating material, the improvement comprising a body of a first, self-supporting arc barrier-forming material at each end portion of said housing member and terminating short of the central portion of said housing, each said body intimately surrounding and extending between the portions of the fuse elements adjacent to the conductive end walls.

8. The fuse of claim 7, wherein said first arc barrier-forming body at each end portion of said housing member forms a plug having an extent which substantially fills each end portion of said housing.

9. The fuse of claim 2, wherein each of said first bodies of arc barrier-forming material extends over and intimately contacts the inner surface of each end wall.

10. A fuse comprising:

a. a pair of conductive, terminal-forming elements at the opposite ends of said fuse;

b. a plurality of laterally-spaced fusible elements secured between and making electrical contact with each of said conductive terminal-forming elements;

c. a housing enclosing said fusible elements, said housing having a central portion and end portions; and, d. an insulating, arc barrier-forming body at each of said end portions of said housing, each such body intimately surrounding said plurality of fusible elements along a portion of their lengths and filling the spaces between said fusible elements; and said fusible elements being laterally spaced and extending around only a portion of a 360 degree circular arc around the longitudinal axis of said housing, and a covered filling aperture in said housing for filling said housing with pulverulent material, said filling aperture being located at a point in said housing where there are no fuse elements extending between said terminal-forming conductive elements, said arc barrier-forming body at each end portion of the housing terminating short of the location of said filling aperture so that each arc barrier-forming body has a generally C-shaped cross section in a plane transverse to the longitudinal axis of said housing and forms a space opposite said filling aperture for receipt of an insulating pulverulent material, and said housing member containing an insulating pulverulent material.

11. In a fuse having an open-ended housing member having a central insulating portion and insulating end portions, and conductive end walls closing the open ends of the housing member, terminals extending from said end walls, a plurality of fuse elements extending between and electrically connected to said end walls and arranged in laterally spaced relation around the longitudinal axis of said housing, and said housing member containing a pulverulent insulating material, the improvement comprising a body of an arc barrier-forming material at each end portion of said housing, each said body intimately surrounding and extending between the portions of the fuse elements adjacent to the conductive end walls; and said fuse elements being spaced around only a portion of a 360 degree circular arc around the longitudinal axis of said housing, and a covered filling aperture in a part of said housing for filling said housing with said pulverulent material, said filling aperture being located at a point in said housing where there are no fuse elements extending between said conductive end walls, and each body of said arc barrier-forming material at each end portion of the housing terminating short of the location of said filling aperture so that each body has a generally C-shaped cross section in a plane transverse to the longitudinal axis of said housing to provide a space opposite said filling aperture for passage of said pulverulent material.

12. A method of making a fuse having an open-ended housing having a central portion and end portions and conductive end walls closing the open ends of the housing, and also having terminal blades extending longitudinally outward from said end walls; and a plurality of fuse elements extending between and electrically connected to said end walls and arranged in spaced relation around the longitudinal axis of said housing, and said housing being filled with a pulverulent insulating material;

said method comprising the steps of:

a. positioning said conductive end walls with said terminal blades extending outwardly from said conductive end walls so that said end walls are confronting, one of said end walls having a filling aperture spaced from the axial center of said end walls;

b. connecting said plurality of fuse elements between the confronting sides of said end walls so that they are arranged in spaced relation around a longitudinal axis extending between the axial centers of said end walls;

c. applying a body of arc barrier-forming material in a plastic, slurry-like state intimately around and between the portions of all of the fuse elements adjacent to each conductive end wall and terminating short of the central portion of the housing;

d. providing a housing with open ends which can be inserted over said end walls;

e. applying said housing fully over said fuse elements and end walls so that the end walls finally close the open ends of said housing; and f. anchoring the housing to said end walls.

13. The method of claim 12, further comprising:

a. filling the remaining spaces in the interior of said housing with a pulverulent material through said filling aperture; and b. sealing said filling aperture.

* * * * *

UNITED STATES PATENT AND TRADEMARK OFFICE

CERTIFICATE OF CORRECTION

PATENT NO. : 5,245,308

DATED : September 14, 1993

INVENTOR(S) : Cesar Herbias

It is certified that error appears in the above-indentified patent and that said Letters Patent is hereby corrected as shown below:

Column 5, line 12, delete "modulating" and insert --insulating--.

Column 8, Claim 9, line 33, delete "2" and insert --7--.

Signed and Sealed this

Twenty-first Day of June, 1994

Bruce Lehman

*Attest:*

BRUCE LEHMAN

*Attesting Officer*

*Commissioner of Patents and Trademarks*